US012710030B2

(12) United States Patent
Volk et al.

(10) Patent No.: US 12,710,030 B2
(45) Date of Patent: Aug. 18, 2026

(54) METHOD OF MANUFACTURING A MODULAR PUMP AND MOTOR ASSEMBLY

(71) Applicant: Franklin Electric Co. Inc., Fort Wayne, IN (US)

(72) Inventors: James J. Volk, Fort Wayne, IN (US); Lander Nordal, Canby, OR (US); Ryan Chin, Portland, OR (US); Jayden Steel, Frasier Rise (AU); William Ross Gates, Canby, OR (US)

(73) Assignee: Franklin Electric Co. Inc., Fort Wayne, IN (US)

( * ) Notice: Subject to any disclaimer, the term of this patent is extended or adjusted under 35 U.S.C. 154(b) by 217 days.

(21) Appl. No.: 18/197,986

(22) Filed: May 16, 2023

(65) Prior Publication Data

US 2023/0374979 A1 Nov. 23, 2023

Related U.S. Application Data

(60) Provisional application No. 63/343,429, filed on May 18, 2022.

(51) Int. Cl.
*F04B 17/06* (2006.01)
*F04B 23/04* (2006.01)
*F04B 53/22* (2006.01)

(52) U.S. Cl.
CPC ..... *F04B 17/06* (2013.01); *F04B 23/04* (2013.01); *F04B 53/22* (2013.01)

(58) Field of Classification Search
CPC . F16M 1/08; F15B 15/18; F04B 17/06; F04B 53/22; F04B 23/04
See application file for complete search history.

(56) References Cited

U.S. PATENT DOCUMENTS

| | | | | |
|---|---|---|---|---|
| 6,450,782 | B1 * | 9/2002 | Sakamoto | F04C 23/00 248/678 |
| 7,028,970 | B1 * | 4/2006 | Wiseman | F16M 5/00 108/51.11 |
| 9,650,879 | B2 * | 5/2017 | Broussard | E21B 43/26 |
| 10,274,124 | B2 * | 4/2019 | Gilmore | F16M 1/08 |
| 12,115,828 | B2 * | 10/2024 | Lauterbach | B60G 13/00 |

* cited by examiner

*Primary Examiner* — Sarang Afzali
(74) *Attorney, Agent, or Firm* — Faegre Drinker Biddle & Reath LLP

(57) ABSTRACT

A modular pump and motor system including a modular frame and motor stool is disclosed.

10 Claims, 15 Drawing Sheets

METHOD OF MANUFACTURING A MODULAR PUMP AND MOTOR ASSEMBLY

BACKGROUND

1. Technical Field

The present disclosure is directed to a modular and configurable pump and motor subassembly. More particularly, the present disclosure is directed to a system of components that facilitates ease of manufacture of a high number of different pump and motor subassemblies without requiring a similarly high number of component parts.

2. Description of the Related Art

Pump and motor subassemblies are useful in a variety of implementations, including those requiring that the subassembly be portable. For example, surface dewatering applications are facilitated by portable pump and motor subassemblies. A supporting frame for a pump and motor combination can be rigidly assembled by, e.g., welding custom frame components together to form a support base for the pump and motor combination. Such a bespoke frame is not able to be disassembled without destruction and rigidly supports the motor output shaft in alignment with the pump input shaft. To assemble a high number of pump and motor combinations, bespoke frame components must be custom made to suit the desired assemblies.

SUMMARY

The present disclosure provides a modular frame system including a plurality of identical side members and a plurality of identical cross members. Throughout this document, "identical" denotes nominally identical, i.e., within manufacturing tolerance. Side members and cross members can be assembled by repeatable fasteners, such as bolt and nut combinations. Throughout this document, "repeatable fastener" denotes a fastener capable of repeatable assembly and disassembly without destruction. For example, a bolt and nut combination exemplifies a repeatable fastener because the nut can be threaded to the bolt and unthreaded therefrom repeatably and without destruction. To ensure constant alignment of the motor output shaft with the pump input shaft, a motor stool provides a rigid connection of the pump housing to the motor housing. Motor stools in accordance with the present disclosure provide indexing features adaptable to multiple motors and multiple pumps to decrease the inventory of motor stools needed to assemble the desired pump and motor combinations.

In one form thereof, the present disclosure provides a method of preparing a pump and a motor combination for use, the method comprising the steps of: choosing the pump from a plurality of pumps; choosing the motor from a plurality of motors; securing the pump to a motor stool; securing the motor to the motor stool; securing a motor output shaft for rotation with a pump input shaft; securing the pump to a first frame cross member chosen from a plurality of identical frame cross members; securing the motor to a second frame cross member chosen from the plurality of nominally identical frame cross members; securing the first frame cross member and the second frame cross member to a first frame side member chosen from a plurality of nominally identical frame side members; and securing the first frame cross member and the second frame cross member to a second frame side member chosen from a plurality of nominally identical frame side members.

In embodiments, the plurality of pumps comprises a first pump having a first pump characteristic from a pump characteristic class and a second pump having a second pump characteristic from the pump characteristic class, the second pump characteristic different from the first pump characteristic, and wherein the step of choosing the pump from the plurality of pumps comprises choosing one of the first pump and the second pump.

In embodiments, the plurality of motors comprises a first motor having a first motor characteristic from a motor characteristic class and a second motor having a second motor characteristic from the motor characteristic class, the second motor characteristic different from the first motor characteristic, and wherein the step of choosing the motor from the plurality of motors comprises choosing one of the first motor and the second motor.

In embodiments, the step of securing the pump to the motor stool comprises the step of piloting the pump to a pump index on the motor stool, the pump index sized and shaped to guide securement of the first pump and the second pump to the motor stool.

In embodiments, the step of securing the motor to the motor stool comprises the step of piloting the motor to one of a first motor index and a second motor index on the motor stool, the first motor index sized and shaped to guide securement of the first motor to the motor stool, the second motor index sized and shaped to guide securement of the second motor to the motor stool, the first motor index different from the second motor index.

In embodiments, the step of securing the motor output shaft for rotation with the pump input shaft occurs after the steps of securing the pump to the motor stool and securing the motor to the motor stool, the step of securing the motor output shaft for rotation with the pump input shaft comprising the steps of: accessing the motor output shaft and the pump input shaft through an access in the motor stool; and coupling the motor output shaft to the pump input shaft with a shaft coupler.

In embodiments, the method further comprises: securing a guard over the access in the motor stool after the step of coupling the motor output shaft to the pump input shaft with a shaft coupler.

In embodiments, the step of securing the pump to the first frame cross member chosen from the plurality of identical frame cross members comprises securing a pump repeatable fastener in a graduated aperture formed through the first frame cross member, the step of securing the pump repeatable fastener comprising positioning the pump repeatable fastener in a portion of the graduated aperture formed through the first frame cross member corresponding to a size of the pump.

In embodiments, the step of securing the motor to the second frame cross member chosen from the plurality of identical frame cross members comprises securing a motor repeatable fastener in a graduated aperture formed through the second frame cross member, the step of securing the motor repeatable fastener comprising positioning the motor repeatable fastener in a portion of the graduated aperture formed through the second frame cross member corresponding to a size of the motor.

In embodiments, the step of securing the first frame cross member and the second frame cross member to a first frame side member chosen from the plurality of identical frame side members comprises: choosing a first aperture from a first array of apertures through the first frame side member;

and securing a first frame repeatable fastener through the first frame cross member and the first aperture; and choosing a second aperture from a second array of apertures through the first frame side member; and securing a second repeatable fastener through the second frame cross member and the second aperture.

In an alternative form of the present disclosure, a modular pump and motor support system is provided, the modular pump and motor support system, comprising: a motor stool comprising an annular body having a first end and a second end, the first end having a pump index sized and shaped to guide securement of a first pump housing and a second pump housing to the motor stool, the second end having a first motor index sized and shaped to guide securement of a first motor housing to the motor stool, the second end having a second motor index sized and shaped to guide securement of a second motor housing to the motor stool, the first motor index different from the second motor index, the annular body defining an access between the first end and the second end, the access sized to allow an operator to operably join a motor shaft to a pump shaft when the motor stool is secured to one of the first pump housing and the second pump housing and the motor stool is secured to one of the first motor housing and the second motor housing.

In embodiments, the modular pump and motor support system further comprises: a plurality of nominally identical frame side members; and a plurality of nominally identical frame cross members, the plurality of nominally identical frame side members and the plurality of nominally identical frame cross members able to be assembled and disassembled with a plurality of repeatable fasteners into a plurality of frames each having a different configuration adapted to support a unique pump and motor combination.

In embodiments, each of the plurality of nominally identical frame side members includes an array of apertures formed by a plurality of apertures, each of the plurality of apertures sized to receive one of the plurality of repeatable fasteners.

In embodiments, each of the plurality of nominally identical frame cross members defines at least one graduated aperture, whereby the graduated aperture defines a progressively larger opening along its length.

In another form of the present disclosure, a modular pump and motor system is provided. The modular pump and motor support system, comprising: a plurality of pumps comprising a first pump having a first pump characteristic from a pump characteristic class and a second pump having a second pump characteristic from the pump characteristic class, the second pump characteristic different from the first pump characteristic; a plurality of motors comprising a first motor having a first motor characteristic from a motor characteristic class and a second motor having a second motor characteristic from the motor characteristic class, the second motor characteristic different from the first motor characteristic; a plurality of motor stools sized and shaped to secure any one of the plurality of motors to any one of the plurality of pumps; and a support frame system supporting a chosen one of the plurality of pumps to a chosen one of the plurality of motors, with a chosen one of the plurality of motor stools secured to the chosen one of the plurality of pumps and to the chosen one of the plurality of motors, wherein the chosen one of the plurality of motor stools maintains operative alignment of a pump shaft of the chosen one of the plurality of pumps and a motor shaft of the chosen one of the plurality of motors, the support frame system comprising: a plurality of nominally identical frame side members; and a plurality of nominally identical frame cross members, the plurality of nominally identical frame side members and the plurality of nominally identical frame cross members able to be assembled and disassembled with a plurality of repeatable fasteners into a plurality of frames each having a different configuration adapted to operably support a unique pump and motor combination, a first one of the plurality of frames having a first configuration adapted to operably support the first pump and the first motor secured together by the motor stool, a second one of the plurality of frames having a second configuration adapted to operably support the first pump and the second motor secured together by the motor stool, a third one of the plurality of frames having a third configuration adapted to operably support the second pump and the first motor secured together by the motor stool, a fourth one of the plurality of frames having a fourth configuration adapted to operably support the second pump and the second motor secured together by the motor stool, the first configuration different from each of the second configuration, the third configuration and the fourth configuration, the second configuration different from each of the first configuration, the third configuration and the fourth configuration, the third configuration different from each of the first configuration, the second configuration and the fourth configuration, the fourth configuration different from each of the first configuration, the second configuration and the third configuration.

In embodiments, the chosen one of the plurality of motor stools comprises an annular body having a first end and a second end, the first end having a pump index sized and shaped to guide securement of the first pump and the second pump to the motor stool, the second end of the chosen one of the plurality of motor stools having a first motor index sized and shaped to guide securement of the first motor to the motor stool, the second end having a second motor index sized and shaped to guide securement of the second motor to the motor stool, the first motor index different from the second motor index.

In embodiments, the annular body of the chosen one of the plurality of motor stools defines an access between the first end and the second end, the access sized to allow an operator to join a motor shaft to a pump shaft when the motor stool is secured to one of the first pump and the second pump and the motor stool is secured to one of the first motor and the second motor.

In embodiments, each of the plurality of nominally identical frame side members includes an array of apertures formed by a plurality of apertures, each of the plurality of apertures sized to receive one of the plurality of repeatable fasteners.

In embodiments, each of the plurality of nominally identical frame cross members defines at least one graduated aperture, whereby the graduated aperture defines a progressively larger opening along its length.

In embodiments, the at least one graduated aperture of each of the plurality of nominally identical frame cross members comprises a first graduated aperture spaced from a second graduated aperture.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Figure 1:
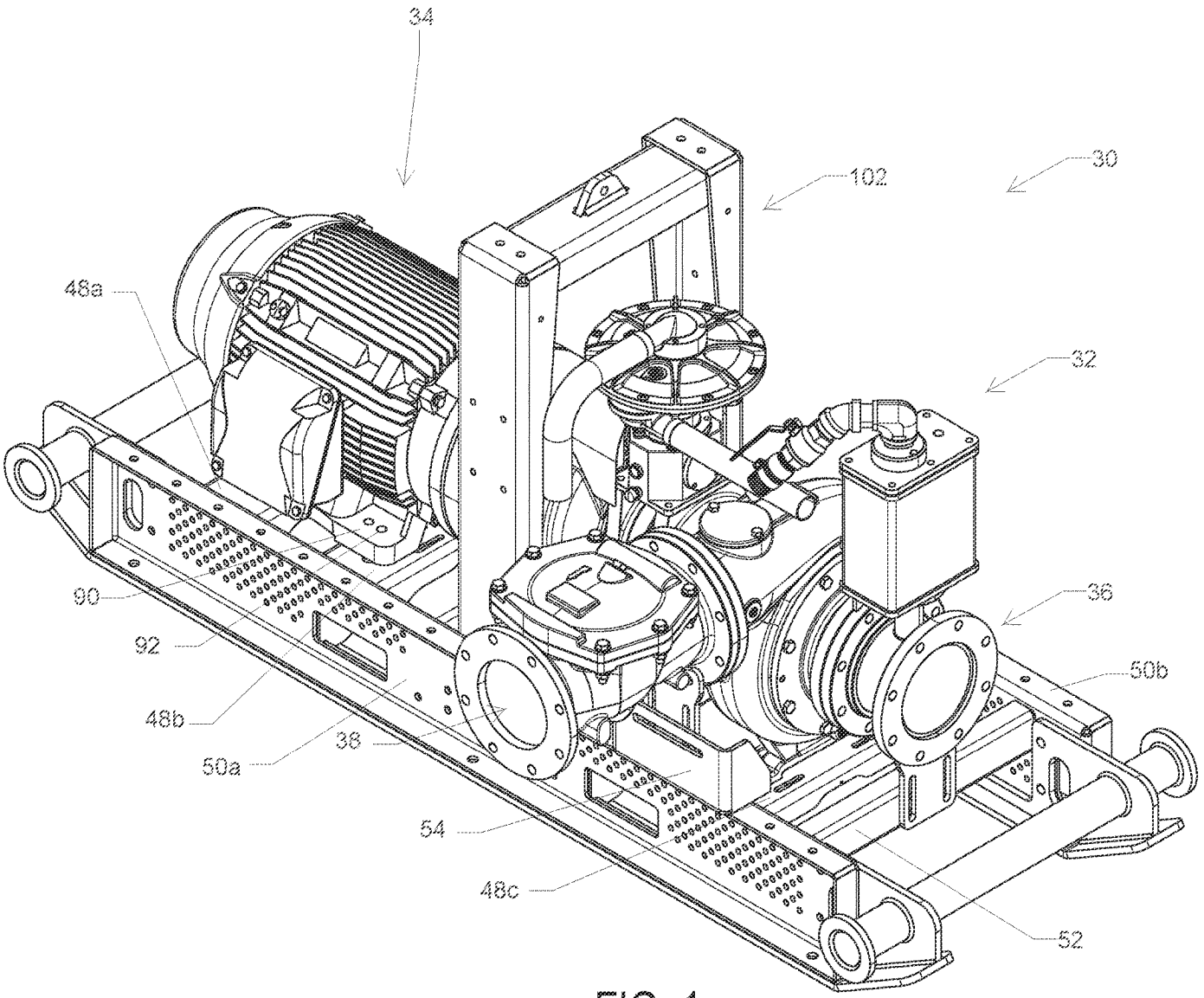
FIG. 1 is a perspective view of a modular pump and motor combination supported on a modular frame on a skid.
Figure 2:
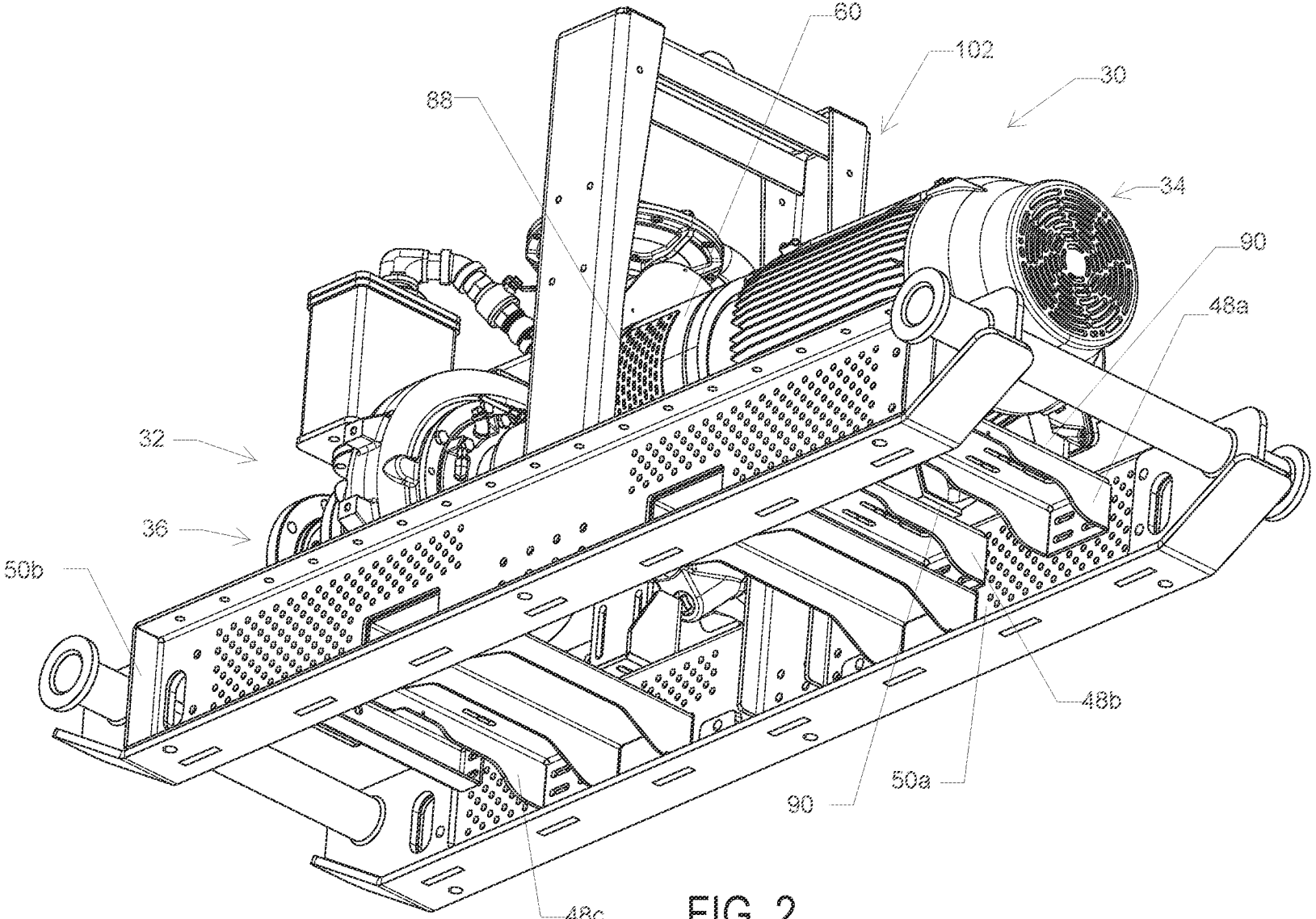
FIG. 2 is another perspective view of the modular pump and motor combination supported on a modular frame on a skid of FIG. 1.

Corresponding reference characters indicate corresponding parts throughout the several views. The exemplification set out herein illustrates an embodiment of the invention, the embodiment disclosed below is not intended to be exhaustive or to be construed as limiting the scope of the invention in any manner.

DETAILED DESCRIPTION

Figure 28:
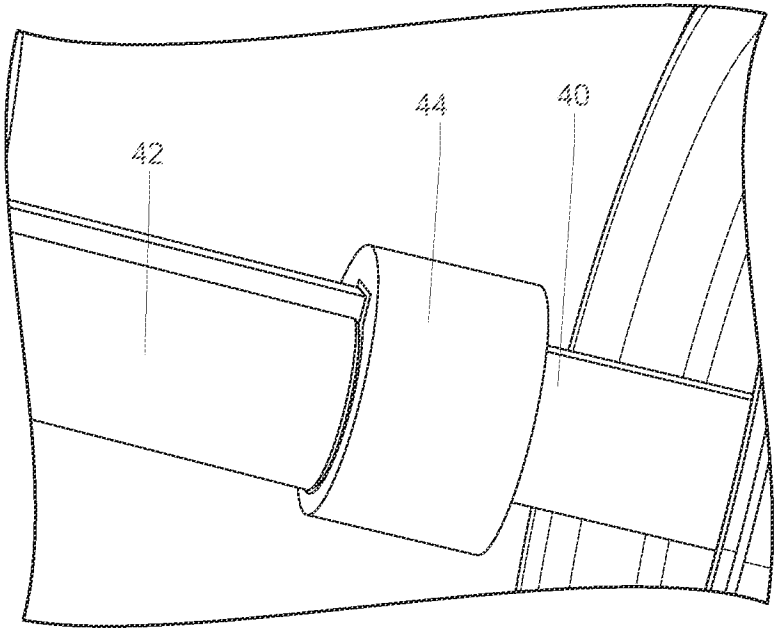
FIG. 28 is a perspective view of a shaft coupler operatively positioned to couple the motor output shaft and the pump input shaft.

FIG. 1 illustrates pump and motor combination 30, including pump 32 and motor 34. In the exemplification illustrated, pump 32 is a centrifugal pump having inlet 36 and outlet 38. Pump 32 includes pump input shaft 40 (FIGS. 27 and 28) which is arranged to receive a rotational input to drive an impeller to create a negative pressure at inlet 36 and to force fluid (or a fluid/solids mix) through outlet 38. Motor 34 includes motor output shaft 42 driven by motor 34 when motor 34 is energized. As illustrated in FIG. 28, shaft coupler 44 is utilized to rotationally couple motor output shaft 42 to pump input shaft 40. Use of shaft coupler 44 to couple motor output shaft 42 to pump input shaft 40 will be further described below.

Throughout this document, any form of the word "couple" includes both arrangements in which the components described as coupled are in direct physical contact as well as arrangements in which the components described as coupled are not in direct contact with each other (e.g., two components are "coupled" via at least a third component, such as pump input shaft 40 and motor output shaft 42 being coupled by shaft coupler 44), but yet still cooperate or interact with each other.

Pump and motor combination 30 is assembled by choosing pump 32 from a plurality of pumps having different pump characteristics in one or more pump characteristic class such as, e.g., max flow, max head, solids size that can be pumped, efficiency and brake horsepower, and by choosing motor 34 from a plurality of motors having different motor characteristics in one or more motor characteristic class such as, e.g., voltage, speed, torque, and rated horsepower. For example, pump 32 may be chosen from a plurality of pumps including a first pump having a first pump characteristic from a pump characteristic class and a second pump having a second pump characteristic from the pump characteristic class, the second pump characteristic different from the first pump characteristic.

For example, the first pump may have a flow rate of 1,600 US gpm, max head of 120 feet and be able to pump solids up to 3 inches, while the second pump may have a flow rate of 44,000 US gpm, max head of 126 feet and be able to pump solids up to 5.9 inches. In the example given, the first pump characteristic and the second pump characteristic can be any one of flow rate, max head, and solids size. The plurality of pumps may also include a third pump having a flow rate of 1,400 US gmp, max head of 120 feet and be able to pump solids up to 3 inches. In this example, the pump characteristic of flow rate would be different between the first pump and the third pump, while the pump characteristics of max head and solids size would be the same.

Exemplary motors of the plurality of motors from which motor 34 is chosen may include a first motor having a peak horsepower of 25 hp @ 3600 rpm, and a second motor having a peak horsepower of 50 hp @ 3600 rpm. Generally, the motor characteristics that differ among individual motors that together make up the plurality of motors from which motor 34 is chosen relate to fuel consumption, continuous horsepower, peak horsepower, and displacement.

Prior pump and motor combinations were rigidly secured to a rigid frame, e.g., a frame fashioned of frame members welded together. Different pump and motor combinations were possible, but a large stock of rigid frames was needed to accommodate the differing elements of the pump and motor combination. The present disclosure provides a method and apparatus that ameliorates that difficulty.

Frame 46 of the present disclosure is operatively assembled from a plurality of frame cross members 48 and a plurality of frame side members 50. Each frame cross member 48 is nominally identical to each other frame cross member 48. Similarly, each frame side member 50 is nominally identical to each other frame side member 50. Frame cross members 48 and frame side members 50 form the principal components of a frame 46 for supporting a pump and motor combination thereon. Secondary components such as inlet support 52 and outlet support 54 may also be implemented, but are not needed.

Frame 46 may be constructed to support a large variety of pump and motor combinations with a stock of only two unique parts, i.e., frame cross member 48 and frame side member 50. To ensure proper operative alignment of motor 34 and pump 32 during pumping operation, motor stool 60 is bolted to motor 34 and pump 32. More particularly, motor stool 60 is bolted to motor housing 58 (FIG. 27) and to pump housing 56.

Figure 5:
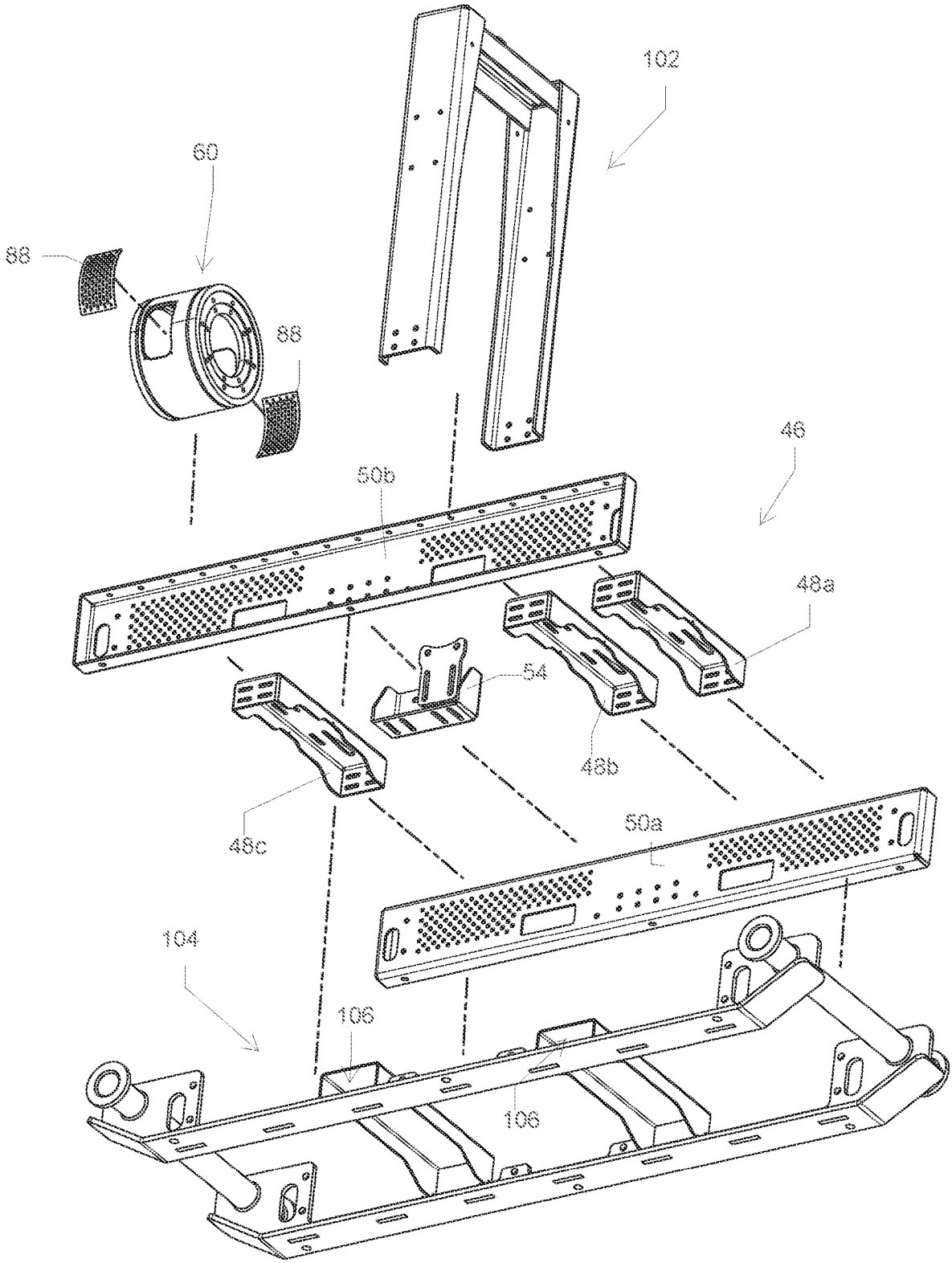
FIG. 5 is an alternative exploded, perspective view of the components illustrated in FIG. 4.
Figure 6:
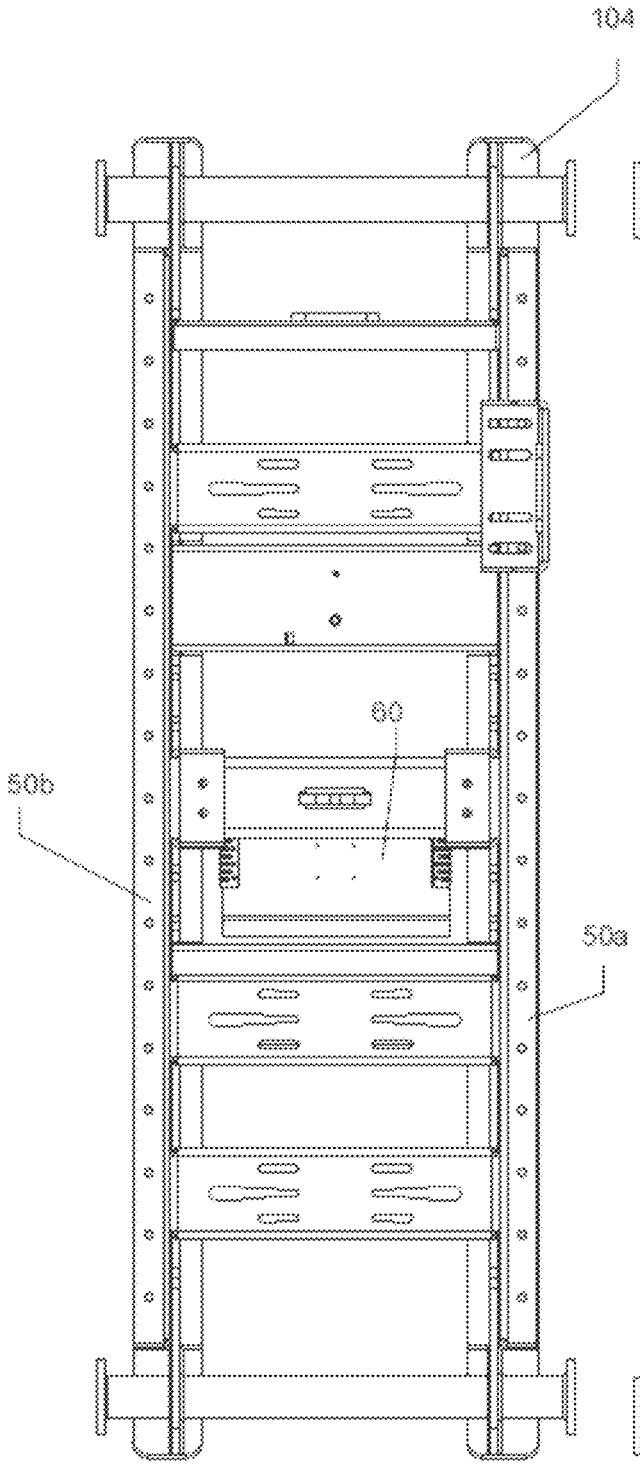
FIG. 6 is a top elevational view of an assembly of the components illustrated in FIGS. 4 and 5.
Figure 6A:
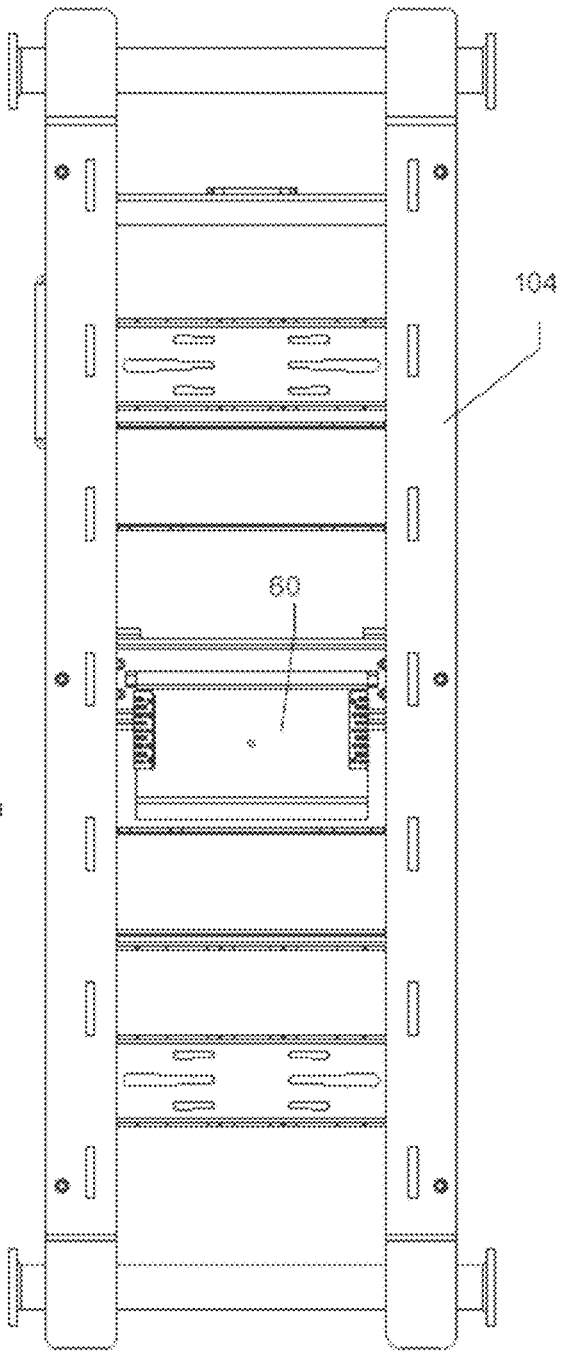
FIG. 6A is a bottom elevational view of an assembly of the components illustrated in FIGS. 4 and 5.
Figure 7:
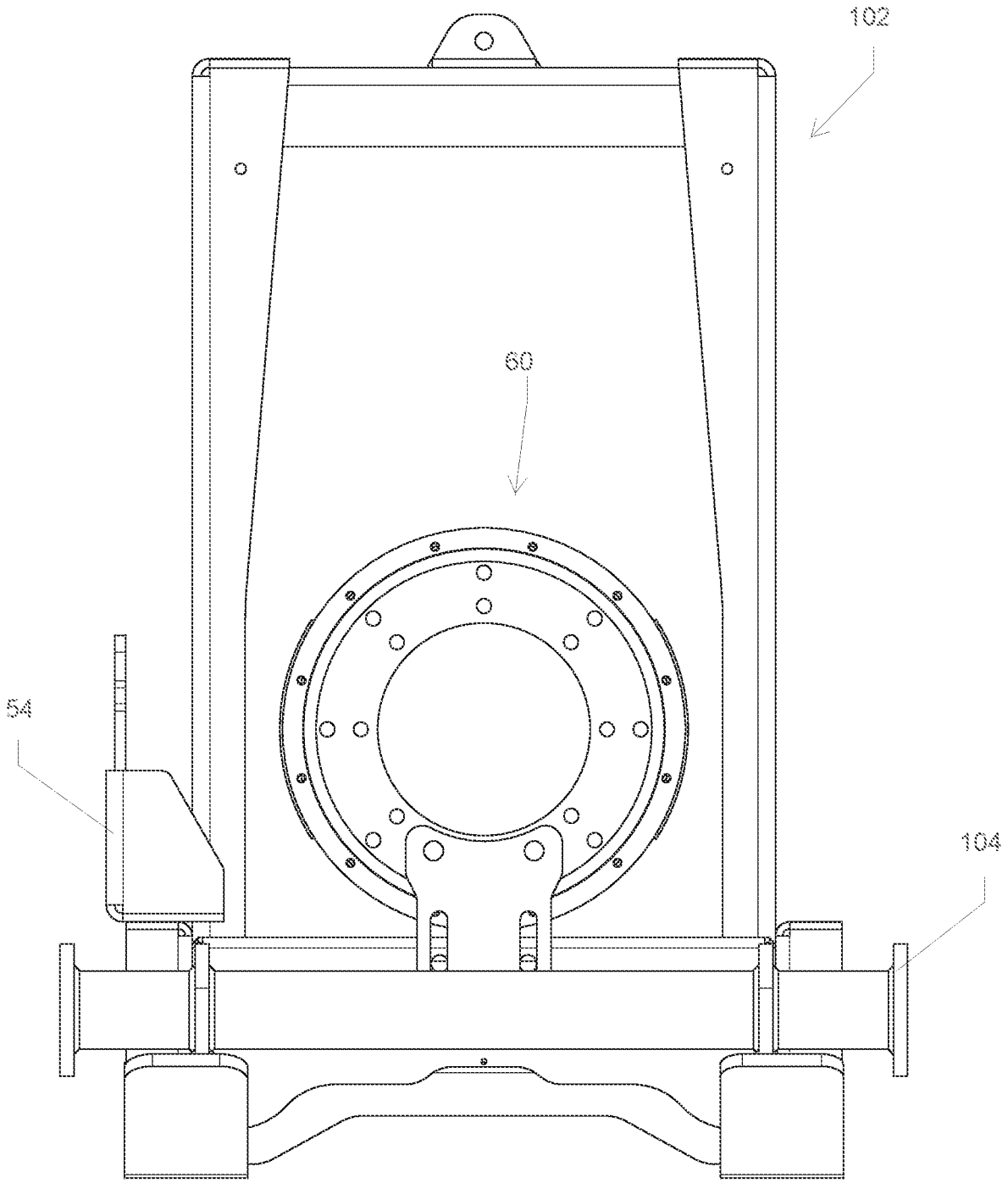
FIG. 7 is an end elevational view of an assembly of the components illustrated in FIGS. 4 and 5.
Figure 10:
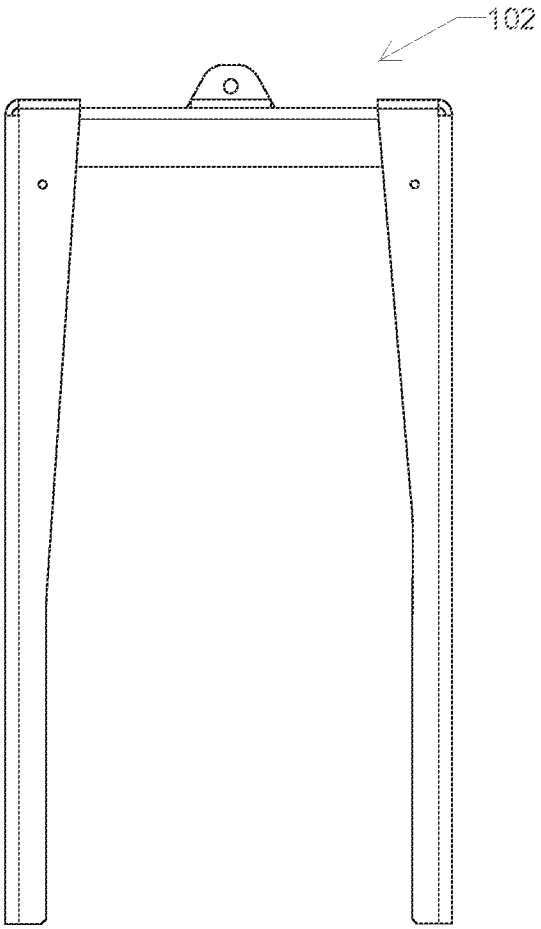
FIG. 10 is a rear elevational view of the lifting bale assembly of FIGS. 8 and 9.
Figure 9:
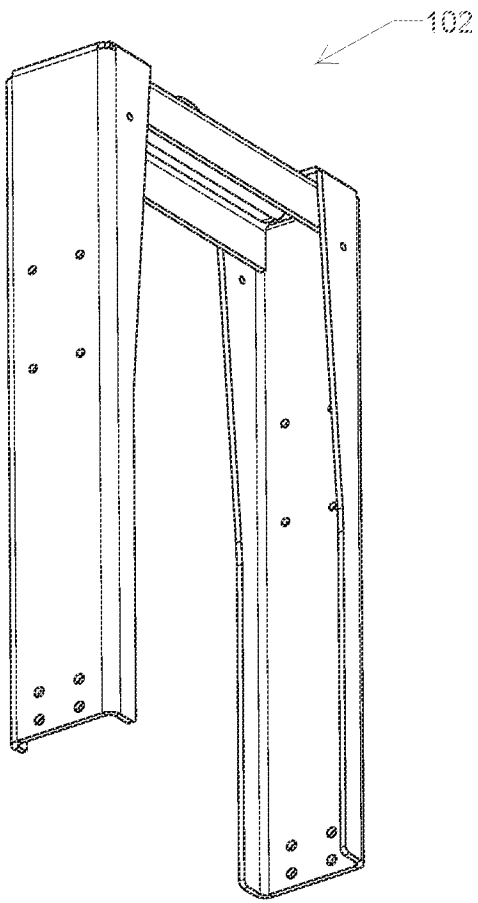
FIG. 9 is a rear perspective view of the lifting bale assembly of FIG. 8.
Figure 8:
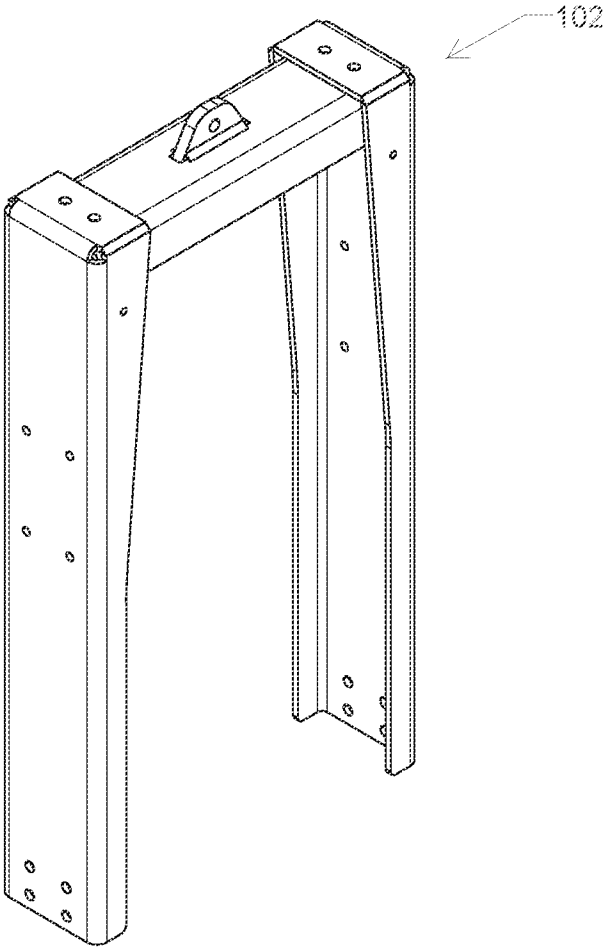
FIG. 8 is front perspective view of a lifting bale assembly usable with the modular frame of the present disclosure.
Figure 11:
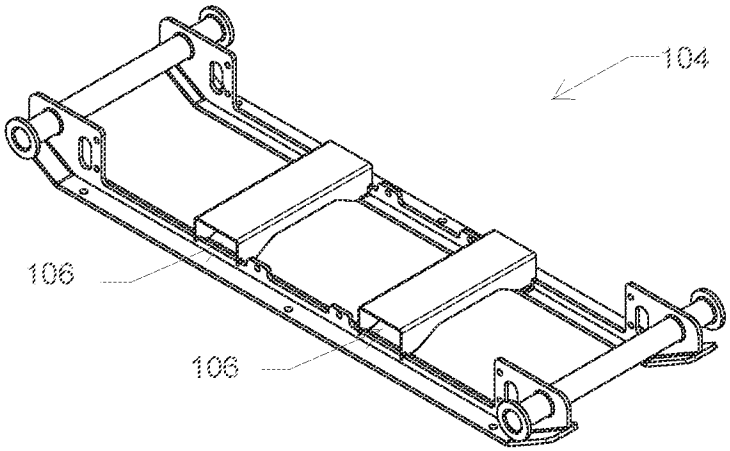
FIG. 11 is a perspective view of a skid on which a modular frame of the present disclosure can be supported.
Figure 12:
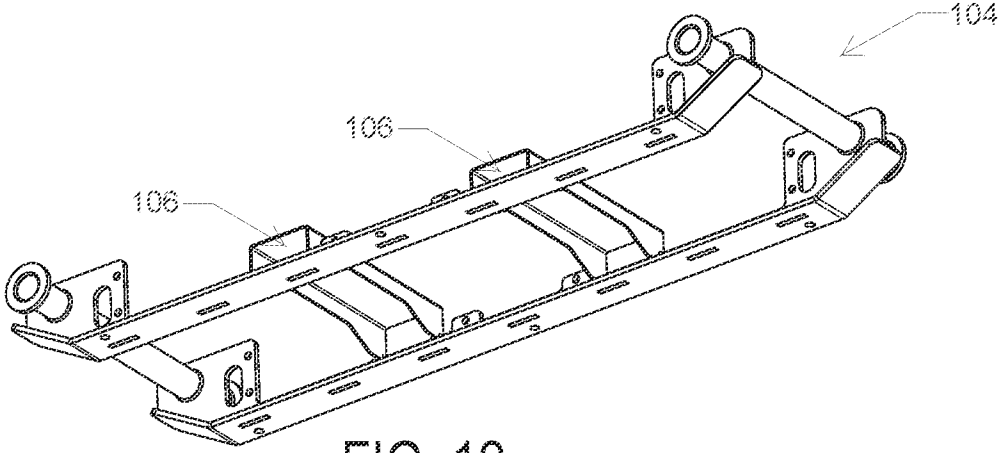
FIG. 12 is an alternative perspective view of the skid of FIG. 11.
Figure 13:
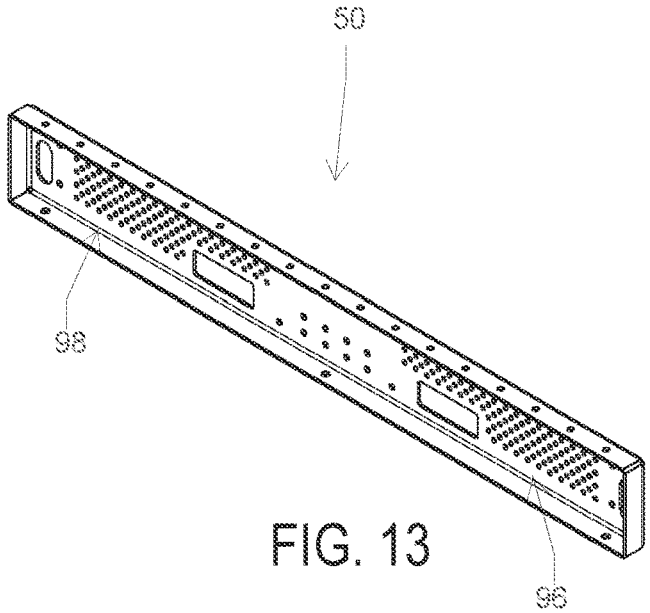
FIG. 13 is an exterior perspective view of a frame side member, which is a component of a modular frame of the present disclosure.
Figure 14:
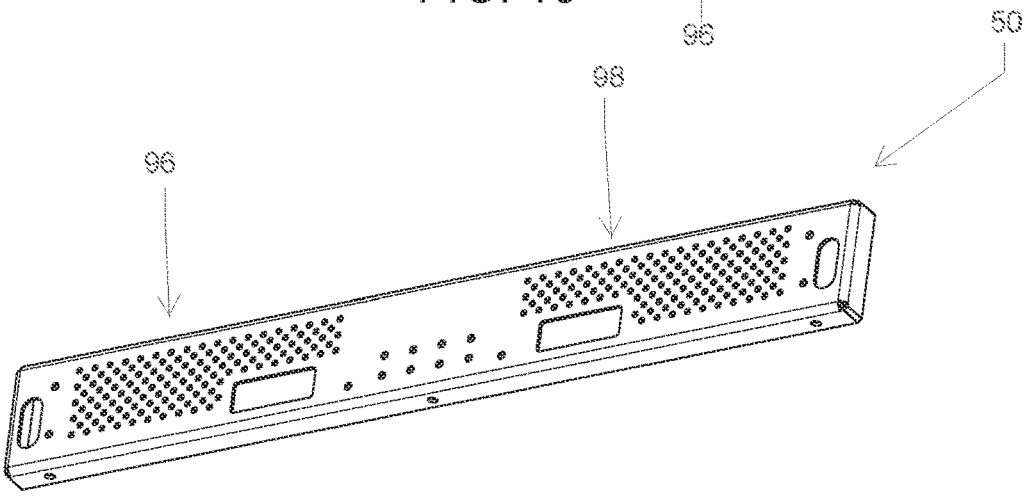
FIG. 14 is an interior perspective view of the frame side member of FIG. 13.
Figure 15:
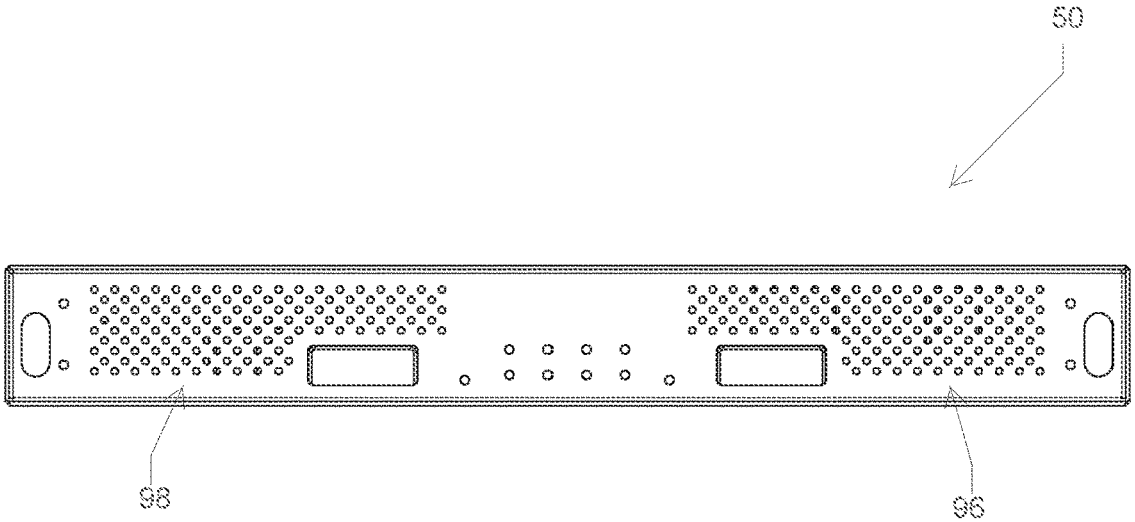
FIG. 15 is a side elevational view of the frame side member of FIGS. 13 and 14.
Figure 18:
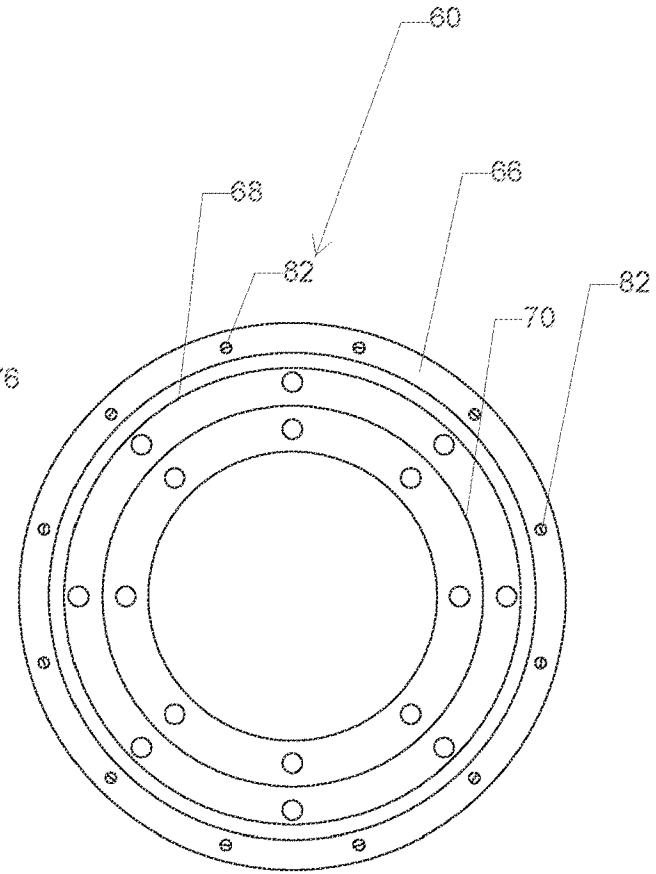
FIG. 18 is a second end elevational view of the motor stool of FIGS. 16 and 17.
Figure 17:
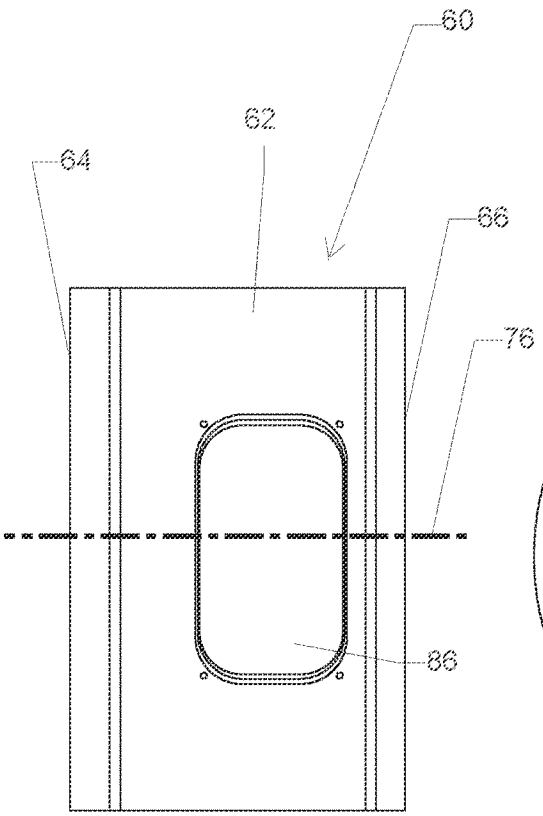
FIG. 17 is a radial elevational view of the motor stool of FIG. 16.
Figure 16:
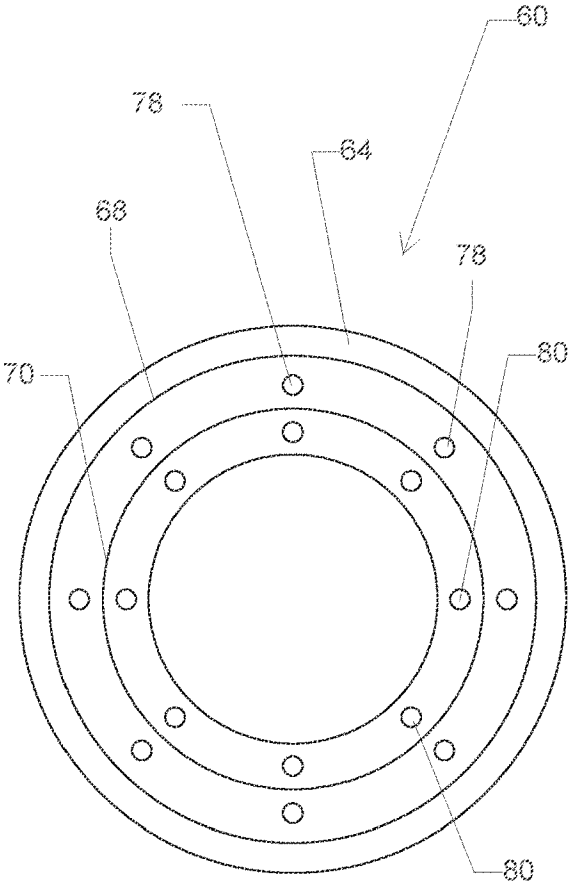
FIG. 16 is a first end elevational view of a motor stool of the present disclosure.
Figure 19:
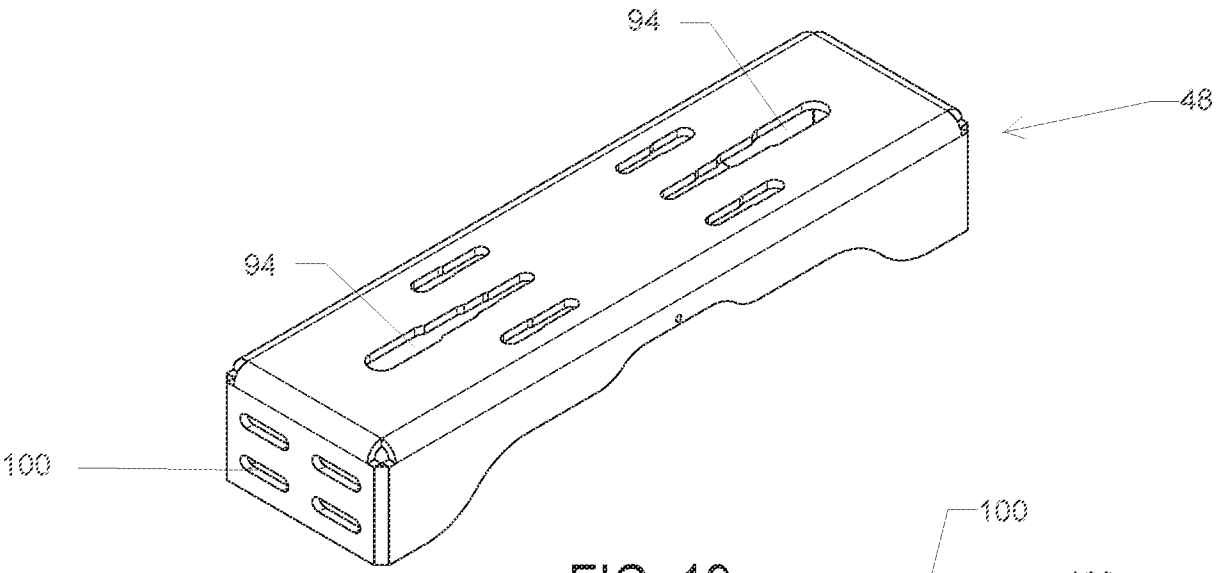
FIG. 19 is a top perspective view of a frame cross member, which is a component of a modular frame of the present disclosure.
Figure 20:
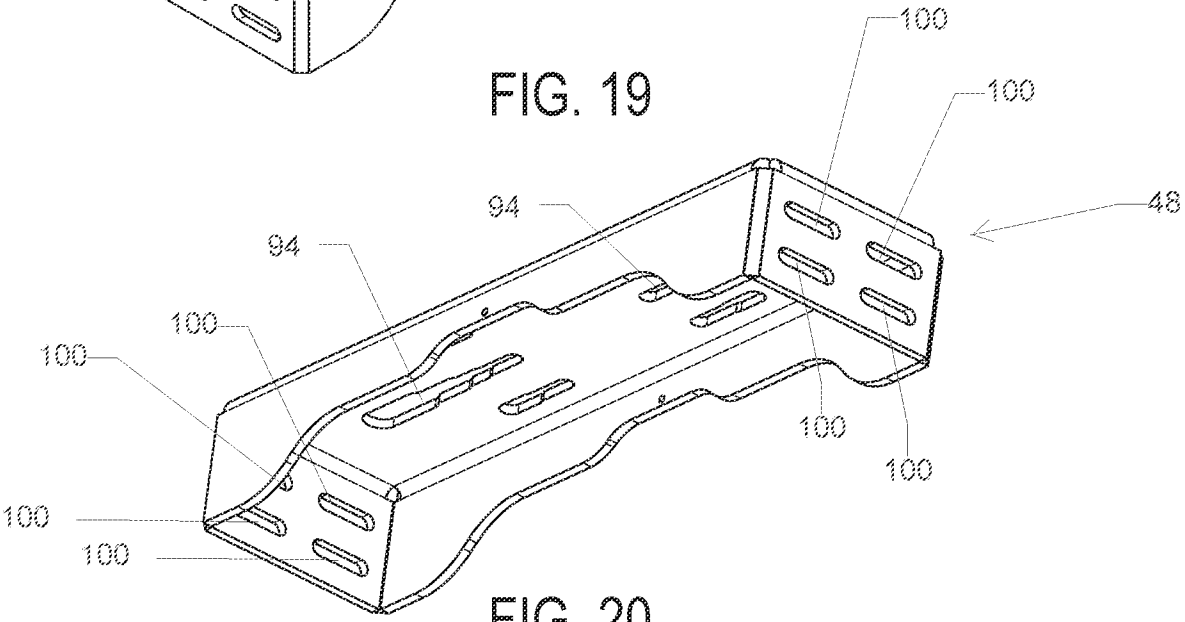
FIG. 20 is a bottom perspective view of the frame cross member of FIG. 19.

Referring to FIGS. 16-18, motor stool 60 includes annular wall 62 spanning motor flange 64 and pump index 66. Motor flange 64 and pump index 66 both extend radially inward from annular wall 62. To account for motors of the plurality of motors from which motor 34 is chosen having differing physical sizes (in addition to different motor characteristics), motor stool 60 includes first motor index 68 and second motor index 70 (see also, e.g., FIG. 5). First motor index 68 is exemplified as a longitudinal wall nominally parallel to longitudinal axis 76 of motor stool 60. First motor index 68 extends a distance of, e.g., one inch and acts as a guide surface to pilot motor 34 into operative engagement with motor stool 60. More particularly, motor housing 58 includes a complementary surface (i.e., a surface that is nominally congruent, but slightly undersized relative to motor index 68) that is aligned with first motor index 68 to index motor stool 60 to motor 34. After piloting motor 34 to motor stool 60, motor securement apertures 78 (only some of which are numbered in the Figs. to avoid unnecessarily complicating the drawings) are aligned with complementary apertures in motor housing 58 to allow fasteners such as lag bolts to secure motor stool 60 to motor housing 58. Alignment of motor securement apertures 78 to corresponding apertures in motor housing 58 may also be done together with the piloting step.

Certain motors of the plurality of motors do not have a surface complementary to first motor index 68, but rather have a surface complementary to second motor index 70. Like first motor index 68, second motor index 70 is exemplified as a longitudinal wall nominally parallel to longitudinal axis 76 of motor stool 60. Second motor index 70 extends a distance of, e.g., one inch and acts as a guide surface to pilot an alternative motor into operative engagement with motor stool 60. More particularly, second motor index 70 acts as a guide for piloting a motor housing having a complementary surface (i.e., a surface that is nominally congruent, but slightly undersized relative to motor index 70) to motor stool 60. After or during the step of piloting a motor chosen from the plurality of motors to motor stool 60 with second motor index 70, motor securement apertures 80 (only some of which are numbered in the Figs. to avoid unnecessarily complicating the drawings) are aligned with complementary apertures in the motor housing to allow fasteners such as lag bolts to secure motor stool 60 to the motor housing.

Pump index 66 of motor stool 60 is configured to align with any of a variety of different SAE brackets (not shown) that are coupled to the housings of any of a variety of different pumps (e.g., diesel powered pumps) to account for pumps of the plurality of pumps from which pump 32 is chosen having differing physical sizes (in addition to different pump characteristics).

Pump index 66 is exemplified as a longitudinal wall nominally parallel to longitudinal axis 76 of motor stool 60. Pump index 66 acts as a guide surface to pilot pump 32 into operative engagement with motor stool 60. More particularly, pump housing 56 includes a complementary surface (i.e., a surface that is nominally congruent, but slightly undersized relative to pump index 66) that is aligned with pump index 66 to index motor stool 60 to pump 32. After piloting pump 32 to motor stool 60, pump securement apertures 82 (only some of which are numbered in the Figs. to avoid unnecessarily complicating the drawings) are aligned with complementary apertures in the SAE bracket attached to pump housing 56 to allow fasteners such as lag bolts to secure motor stool 60 to the SAE bracket. Alignment of pump securement apertures 82 to corresponding apertures in the SAE bracket may also be done together with the piloting step.

Figure 4:
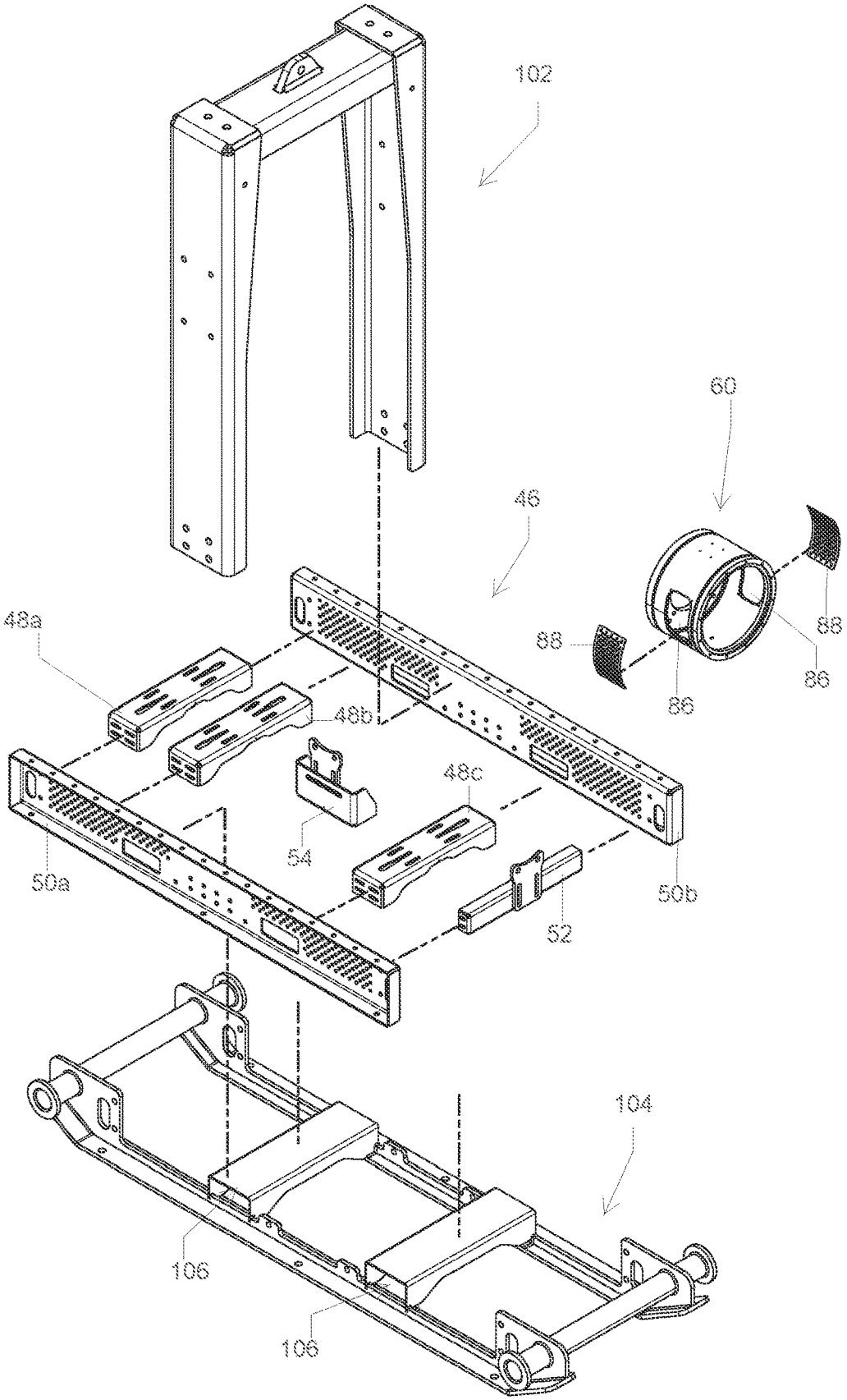
FIG. 4 is an exploded, perspective view of the modular frame together with optional frame components, a motor stool, lifting bale, and a skid.
Figure 27:
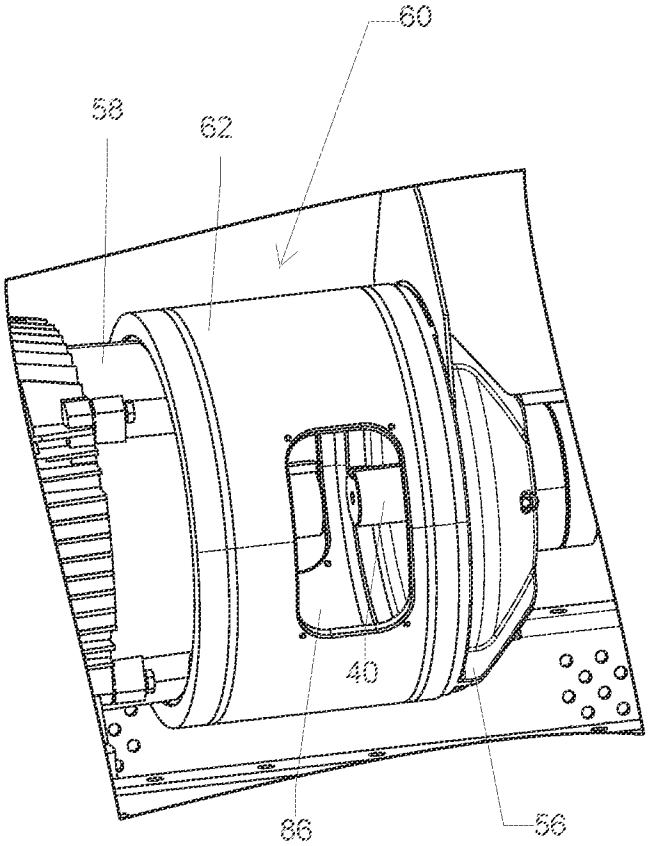
FIG. 27 is a perspective view of a motor stool of the present disclosure, with the guard removed from the access to allow coupling and/or decoupling of the motor output shaft and the pump input shaft.

With one of pump 32 and motor 34 secured to motor stool 60, the other of pump 32 and motor 34 can be secured to motor stool 60, with the fasteners accessed through access 86. Referring to FIG. 4, motor stool 60 includes two accesses 86, one on either side of motor stool 60. Each access 86 is defined by an opening through annular wall 62. Referring to FIGS. 27 and 28, with motor stool 60 secured to pump 32 and to motor 34, motor output shaft 40, which extends from motor housing 58 into an open interior of motor stool 60 defined by annular wall 62, can be accessed through one of accesses 86. Pump input shaft 40, which extends from pump housing 56 into the open interior of motor stool 60 defined by annular wall 62 can similarly be accessed. Shaft coupler 44 includes a keying feature allowing shaft coupler 44 to be rotationally keyed to both motor output shaft 42 and pump input shaft 40. With pump 32 and motor 34 secured to motor stool 60, as previously described, motor output shaft 42 is aligned with pump input shaft 40 and shaft coupler 44 can be slid along the rotational axis shared by motor output shaft 42 and pump input shaft 40 from engagement with only one of motor output shaft 42 and pump input shaft 40 to engagement with both so that motor output shaft 42 is fixed for rotation with pump input shaft 40.

When accesses 86 are no longer needed to allow for securing motor stool 60 in operative position with respect pump 32 and motor 34 and for rotationally securing motor output shaft 42 to pump input shaft 40, guards 88 can be secured by fasteners to annular wall 62 of motor stool 60. In the exemplification illustrated, guards are perforated to allow airflow into and out of the interior of motor stool 60 defined by annular wall 62. Additional motor stools from which motor stool 60 is chosen may also form a part of the kit from which a pump, motor, and frame subassembly may be assembled. More particularly, the present exemplification features a second motor stool having the same design features of motor stool 60, but with the geometry scaled up, for example with a 1.1 scale factor.

Figure 3:
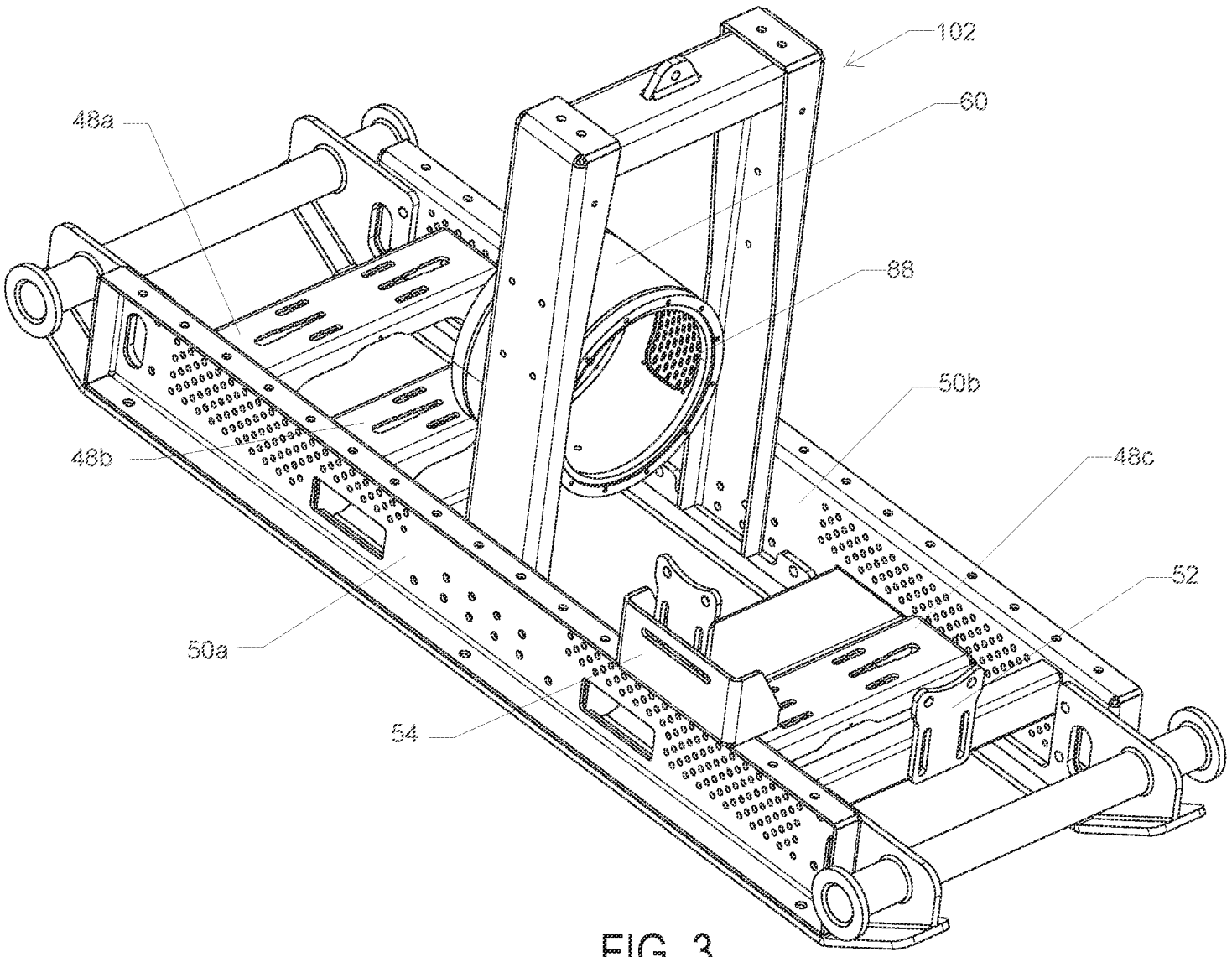
FIG. 3 is a perspective view similar to FIG. 1, but with the pump and motor removed to better illustrate the motor stool and modular frame.

In the exemplification illustrated, two frame cross members 48 are secured to motor 34. Referring to FIGS. 1 and 3, motor 34 includes two sets of feet 90, with a first set of feet 90 extending from motor 34 at a first position along the longitudinal axis of motor 34 corresponding to frame cross member 48*a* and a second set of feet 90 extending from motor 34 at a second position along the longitudinal axis of motor 34 corresponding to frame cross member 48*b*. In this document, a "set" or "pair" of feet 90 refers to two feet 90 extending at nominally the same position along the longitudinal axis of motor 34, with each foot of the pair or set extending from motor 34 on an opposite side of a vertical plane including the longitudinal axis of motor 34. Each foot 90 includes at least one aperture 92 through which a faster such as a lag bolt can be passed to secure foot 90 to a frame cross member 48.

Figure 21:
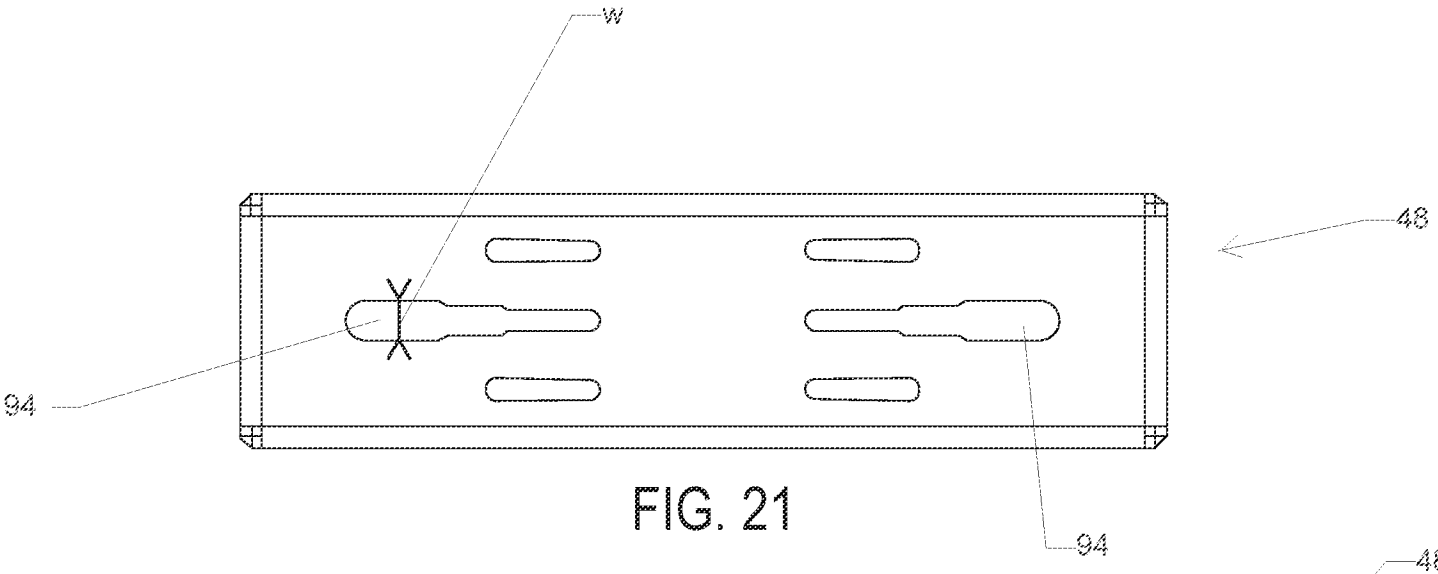
FIG. 21 is a plan view of the frame cross member of FIGS. 19 and 20.
Figure 23:
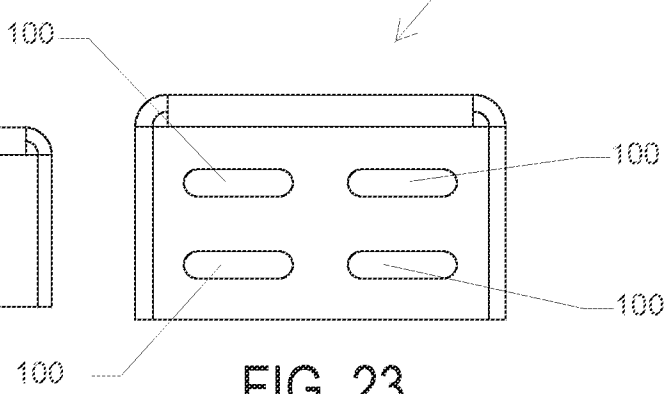
FIG. 23 is an end elevational view of the frame cross member of FIGS. 19-22.
Figure 22:
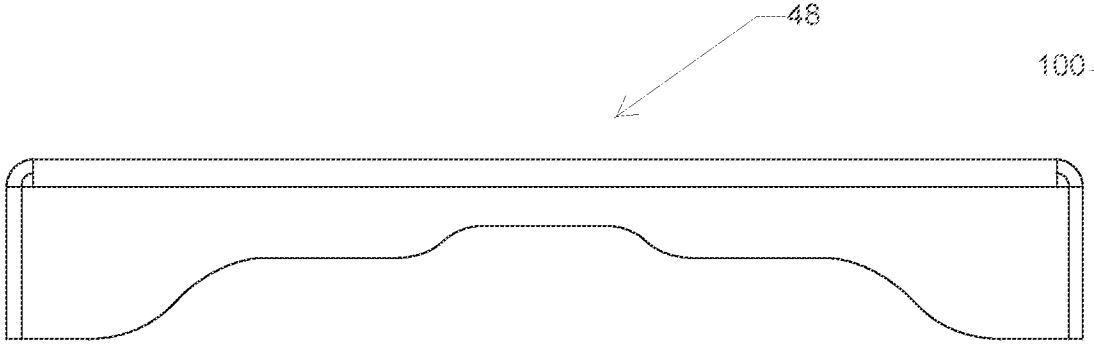
FIG. 22 is a lateral elevational view of the frame cross member of FIGS. 19-21.
Figure 24:
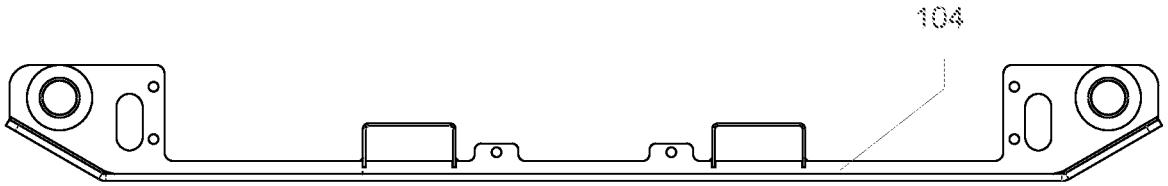
FIG. 24 is a side elevational view of a skid useable with the modular frame of the present disclosure.
Figure 25:
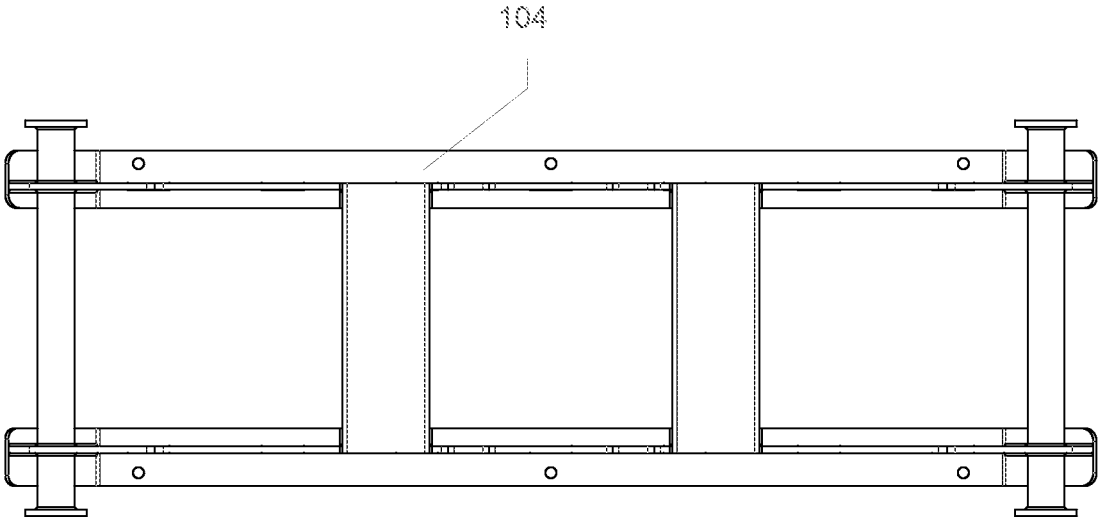
FIG. 25 is a plan view of the skid of FIG. 24.
Figure 26:
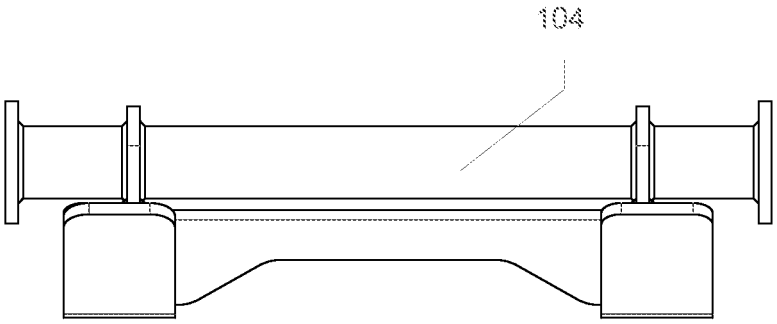
FIG. 26 is an end elevational view of the skid of FIGS. 24 and 25.

Referring to FIG. 21, each frame cross member 48 includes a pair of graduated apertures 94 corresponding to a pair of feet 90 extending from motor 34. Graduated apertures 94 each progressively increase in width w from a position closer to the center of the frame cross member to a position further from the center of the frame cross member. Certain motors from the plurality of motors from which motor 34 is chosen have each pair of feet dimensioned such that apertures 92, one from each foot of a pair of feet, are aligned with the inner most, smallest width portion of graduated apertures 94 on a frame cross member 48 to secure these motors to frame cross member 48. Feet of these motors include apertures 92 having a diameter nominally equal to the width of graduated apertures 94 at the smallest width of graduated apertures 94. In this way, the smallest width portion of graduated apertures 94 corresponds to the size of the motor chosen. A fastener is passed through apertures 92 and the smallest width portion of graduated apertures 94 to secure these motors to frame cross member 48.

Certain other motors from the plurality of motors from which motor 34 is chosen have each pair of feet dimensioned such that apertures 92, one from each foot of a pair of feet, are aligned with the intermediate, middle width portion of graduated apertures 94 on a frame cross member 48 to secure these certain other motors to frame cross member 48. Feet of these motors include apertures 92 having a diameter nominally equal to the width of graduated apertures 94 at the middle (between the largest and the smallest) width of graduated apertures 94. In this way, the middle width portion of graduated apertures 94 corresponds to the size of the motor chosen. A fastener is passed through apertures 92 and the middle width portion of graduated apertures 94 to secure these motors to frame cross member 48.

Certain alternative motors from the plurality of motors from which motor 34 is chosen have each pair of feet dimensioned such that apertures 92, one from each foot of a pair of feet, are aligned with the outside, largest width portion of graduated apertures 94 on a frame cross member 48 to secure these certain alternative motors to frame cross member 48. Feet of these motors include apertures 92 having a diameter nominally equal to the width of graduated apertures 94 at the largest width of graduated apertures 94. In this way, the largest width portion of graduated apertures 94 corresponds to the size of the motor chosen. A fastener is passed through apertures 92 and the largest width portion of graduated apertures 94 to secure these motors to frame cross member 48.

Graduated apertures 94 also correspond to a pair of feet extending from pump 32. As with motor 34, certain pumps of the plurality of pumps from which pump 32 is chosen have a pair of feet dimensioned such that an aperture from each one of the pair of feet is aligned with the inner most, smallest width portion of graduated apertures 94 on a frame cross member 48 to secure these pumps to frame cross member 48. Feet of these pumps include apertures having a diameter nominally equal to the width of graduated apertures 94 at the smallest width of graduated apertures 94. In this way, the smallest width portion of graduated apertures 94 corresponds to the size of the pump chosen. A fastener is passed through the apertures through the feet of the chosen pump and through the smallest width portion of graduated apertures 94 to secure these pumps to frame cross member 48.

Certain other pumps from the plurality of pumps from which pump 32 is chosen have a pair of feet dimensioned such that an aperture from each one of the pair of feet is aligned with the intermediate, middle width portion of graduated apertures 94 on a frame cross member 48 to secure these pumps to frame cross member 48. Feet of these pumps include apertures having a diameter nominally equal to the width of graduated apertures 94 at the middle width of graduated apertures 94. In this way, the middle width portion of graduated apertures 94 corresponds to the size of the pump chosen. A fastener is passed through the apertures through the feet of the chosen pump and through the middle width portion of graduated apertures 94 to secure these pumps to frame cross member 48.

Certain alternative pumps from the plurality of pumps from which pump 32 is chosen have a pair of feet dimensioned such that an aperture from each one of the pair of feet is aligned with the outside, largest width portion of graduated apertures 94 on a frame cross member 48 to secure these pumps to frame cross member 48. Feet of these pumps include apertures having a diameter nominally equal to the width of graduated apertures 94 at the largest width of graduated apertures 94. In this way, the largest width portion of graduated apertures 94 corresponds to the size of the pump chosen. A fastener is passed through the apertures through the feet of the chosen pump and through the largest width portion of graduated apertures 94 to secure these pumps to frame cross member 48.

With pump 32 chosen from the plurality of pumps and motor 34 chosen from the plurality of motors, pump 32 secured to motor 34 via motor stool 60, motor 34 secured to frame cross members 48*a*, 48*b* and pump 32 secured to frame cross member 48*c*, frame 46 can be assembled. Specifically, frame cross members 48*a*, 48*b*, and 48*c* are joined to frame side members 50*a*, 50*b* to form frame 46.

Referring to FIGS. 1-5, and 13-15, each frame side member 50 includes a first array of apertures 96 and a second array of apertures 98. Each of first array of apertures 96 and second array of apertures 98 is formed by a plurality of fastener apertures of nominally identical diameter that are arranged to form an array, i.e., a grouping of fastener apertures having a regular order and arrangement. To assemble frame 46, a plurality fasteners (e.g., lag bolts) having a diameter only slightly smaller (e.g., nominally 1/32" smaller) than the fastener apertures of first array of apertures 96 and second array of apertures 98 are each passed through a fastener aperture and into a fastener slot 100 in a frame cross member 48. Fastener slots 100 and the fastener apertures of first array of apertures and second array of apertures are sized and spaced to allow for pump and motor combination 30 to be formed from any one of the plurality of pumps from which pump 32 is chosen and from any one of the plurality of motors from which motor 34 is chosen. While a certain order of construction steps is presented in this exemplary description, this ordering need not be followed.

Frame side members 50 are all nominally identical. Referring to FIG. 4, frame side member 50*a* could be rotated 180 degrees about a vertical axis to replace frame side member 50*b*. Similarly, frame cross members 48 are all identical. Both frame side members 50 and frame cross members 48 are symmetrical about a vertical axis such that ½ of each frame member is a mirror image of the other ½ about a vertical plane containing the axis of symmetry. Therefore, a stock of only two parts, i.e., frame side members 50 and frame cross members 48 is needed to provide frames for all of the possible pump and motor combinations from the plurality of pumps and the plurality of motors from which pump 32 and motor 34 are chosen. Additional supports such as inlet support 52 and outlet support 54 may be secured to frame 46, but are not needed. Inlet support 52 and outlet support 54 can be secured by one or more fasteners such as lag bolts to frame 46 and used to provide support to inlet 36 and outlet 38, respectively.

Lifting bale 102 may also be secured to frame 46 to provide an attachment point for lifting pump and motor combination 30 supported on frame 46 with, e.g., a crane. Frame 46, with pump and motor combination 30 supported thereon may be supported on drag skid 104 to facilitate transportation. Drag skid 104 includes forklift pockets 106 for receiving the blades of a forklift to facilitate transportation of pump and motor combination 30 supported on frame 46. Forklift pockets 106 align with apertures through frame side members 50 when frame 46 is secured to drag skid 104. Frame 46 may be bolted to drag skid 104 to ensure a secure connection therebetween. For example, frame 46 may includes multiple apertures through frame side members 50 outside of first array of apertures 96 and second array of apertures 98 that align with corresponding apertures through drag skid 104 to receive bolts to secure frame 46 to drag skid 104.

While this invention has been described as having exemplary designs, the present invention may be further modified with the spirit and scope of this disclosure. Further, this application is intended to cover such departures from the present disclosure as come within known or customary practice in the art to which this invention pertains.

What is claimed is:

1. A method of preparing a pump and a motor combination for use, the method comprising the steps of:

choosing a selected pump from a plurality of pumps;

choosing a selected motor from a plurality of motors;

securing the selected pump to a pump flange extending radially inward from an annular wall of a motor stool;

securing the selected motor to a motor flange extending radially inward from the annular wall of the motor stool;

securing a motor output shaft for rotation with a pump input shaft;

securing the selected pump to a first frame cross member chosen from a plurality of nominally identical frame cross members;

securing the selected motor to a second frame cross member chosen from the plurality of nominally identical frame cross members;

securing the first frame cross member and the second frame cross member to a first frame side member chosen from a plurality of nominally identical frame side members; and securing the first frame cross member and the second frame cross member to a second frame side member chosen from the plurality of nominally identical frame side members.

2. The method of claim 1, wherein the plurality of pumps comprises a first pump having a first pump characteristic from a pump characteristic class and a second pump having a second pump characteristic from the pump characteristic class, the second pump characteristic being different from the first pump characteristic, and wherein the step of choosing a selected pump from the plurality of pumps comprises choosing one of the first pump and the second pump as the selected pump.

3. The method of claim 2, wherein the step of securing the selected pump to the pump flange comprises the step of piloting the selected pump to a pump index including a pump index longitudinal wall nominally parallel to a longitudinal axis of the motor stool, the pump index being sized and shaped to guide securement of the first pump and the second pump to the motor stool.

4. The method of claim 1, wherein the plurality of motors comprises a first motor having a first motor characteristic from a motor characteristic class and a second motor having a second motor characteristic from the motor characteristic class, the second motor characteristic different from the first motor characteristic, and wherein the step of choosing a selected motor from the plurality of motors comprises choosing one of the first motor and the second motor as the selected motor.

5. The method of claim 4, wherein the step of securing the selected motor to the motor flange comprises a step of piloting the selected motor to one of a first motor index including a first motor index longitudinal wall nominally parallel to a longitudinal axis of the motor stool and a second motor index including a second motor index longitudinal wall nominally parallel to the longitudinal axis of the motor stool, the first motor index being sized and shaped to guide securement of the first motor to the motor stool, the second motor index being sized and shaped to guide securement of the second motor to the motor stool, the first motor index being different from the second motor index.

6. The method of claim 1, wherein the step of securing the motor output shaft for rotation with the pump input shaft occurs after the steps of securing the selected pump to the pump flange and securing the selected motor to the motor flange, the step of securing the motor output shaft for rotation with the pump input shaft comprising the steps of:

accessing the motor output shaft and the pump input shaft through an access in the motor stool; and coupling the motor output shaft to the pump input shaft with a shaft coupler.

7. The method of claim 6, further comprising:

securing a guard over the access in the motor stool after the step of coupling the motor output shaft to the pump input shaft with a shaft coupler.

8. The method of claim 1, wherein the step of securing the selected pump to the first frame cross member chosen from the plurality of nominally identical frame cross members comprises securing a pump repeatable fastener in a graduated aperture formed through the first frame cross member, the step of securing the pump repeatable fastener comprising positioning the pump repeatable fastener in a portion of the graduated aperture formed through the first frame cross member corresponding to a size of the selected pump.

9. The method of claim 8, wherein the step of securing the selected motor to the second frame cross member chosen from the plurality of nominally identical frame cross members comprises securing a motor repeatable fastener in a graduated aperture formed through the second frame cross member, the step of securing the motor repeatable fastener comprising positioning the motor repeatable fastener in a portion of the graduated aperture formed through the second frame cross member corresponding to a size of the selected motor.

10. The method of claim 1, wherein the step of securing the first frame cross member and the second frame cross member to a first frame side member chosen from the plurality of nominally identical frame side members comprises:

choosing a first aperture from a first array of apertures through the first frame side member;

securing a first frame repeatable fastener through the first frame cross member and the first aperture;

choosing a second aperture from a second array of apertures through the first frame side member; and securing a second repeatable fastener through the second frame cross member and the second aperture.

* * * * *